United States Patent [19]

Kratzer

[11] 4,166,333

[45] Sep. 4, 1979

[54] SPENT SHELL CONTAINER

[76] Inventor: Erich E. F. Kratzer, 26 Bight Ct., Mermaid Beach, Queensland, 4218, Australia

[21] Appl. No.: 855,255

[22] Filed: Nov. 28, 1977

[30] Foreign Application Priority Data

Dec. 3, 1976 [AU] Australia ..... PC8360

[51] Int. Cl.[2] ..... F41C 27/00

[52] U.S. Cl. ..... 42/1 T

[58] Field of Search ..... 42/1 T; 89/33 F

[56] References Cited

U.S. PATENT DOCUMENTS 1,346,329 7/1920 Mehta ..... 42/1 T

*Primary Examiner*—Stephen C. Bentley

[57] ABSTRACT

A container assembly adapted to be mounted adjacent the action of a firearm for gathering the shells as they are ejected from the firearm, whereby the spent shells may be collected for re-use.

6 Claims, 5 Drawing Figures

SPENT SHELL CONTAINER

This invention relates to a container for spent firearm shells.

At present, both sporting shooters and target shooters have difficulty gathering spent shells as they are used. The sporting shooter has the obvious difficulty that he often operates in uncleared terrain and thus the ejected shell is easily lost, especially if the shooter is on the move pursuing game. On the other hand, target shooters such as, say pistol shooters, fire in close proximity to one another so that any one shooter may have difficulty in collecting his own spent shells. As each shell has a particular life and a particular quality, each shooter endeavours to collect his own spent shells and not the shells of other shooters which may be worn out or of inferior quality. Normally sporting shooters reload their collected shells for reasons of economy and accuracy, and the shell, which is commonly made of brass, or has a brass content, constitutes a significant part of the cost of the ammunition.

Accordingly, it is an object of the present invention to provide a container for spent firearm shells which will enable a shooter to retain all spentshells for future re-use. It is also an object of the present invention to provide such a container which will be reliable and efficient in use and of robust construction. Other objects and advantages of the invention will hereinafter become apparent.

With the foregoing and other objects in view, this invention resides broadly in a container assembly for gathering ejected firearm shells, said assembly including a housing and attachment means for securing said housing to a firearm adjacent the shell ejection outlet of the firearm, said housing including containment means for said shells, an inlet to said containment means and a discharge outlet from said containment means and deflector means adapted, when said container assembly is operatively secured to a firearm, to direct each shell ejected from said firearm through said inlet into said containment means.

Preferably, said containment means is disposed below said shell ejection outlet and said deflector means is arranged to direct each ejected shell downwards into said containment means.

In order that the invention may be more readily understood and put into practical effect, reference will now be made to the accompanying drawings which illustrate the invention and wherein.

Figure 1:
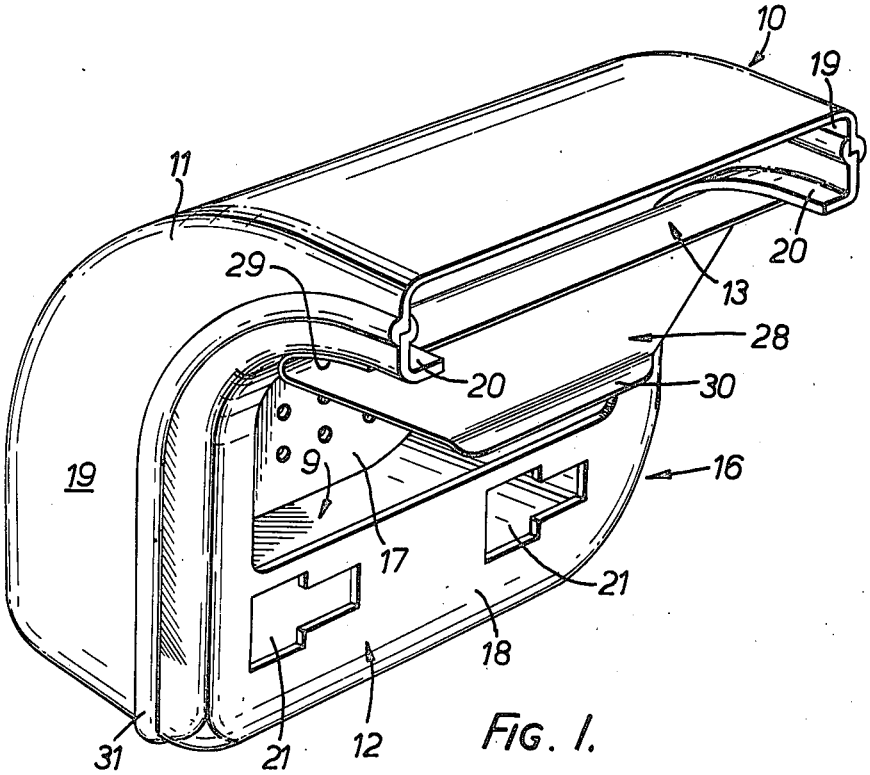
FIG. 1 is a perspective view of a spent shell container according to the present invention.
Figure 2:
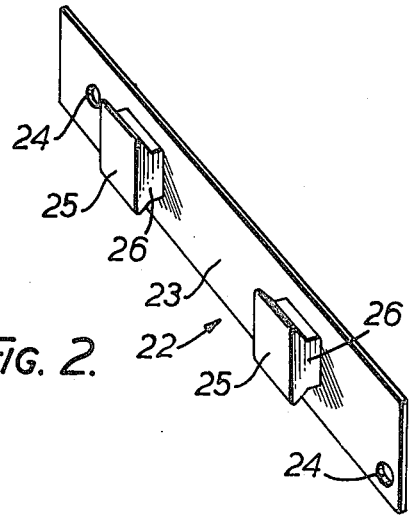
FIG. 2 is a perspective view illustrating the mounting bracket for the container shown in FIG. 1.

Referring to the embodiments shown in FIGS. 1 to 4, it will be seen that the container 10 comprises a housing 11 providing a lower containment means 12 and an uppermost discharge outlet 13. The container is adapted to be mounted adjacent the shell ejection outlet of a rifle as shown, or other firearm, adjacent the action 15 of the rifle 14. In this embodiment, the illustrated rifle is an automatic rifle and a telescopic sight is shown in dotted outline in its operative position.

The housing 11 has a lower substantially rectangular body portion 16 having a back wall 17 and a cut-away front wall 18 arranged to provide an opening 9 as the inlet for the spent shells ejected from the rifle into the containment means 12. The back wall 17 extends arcuately upwards and inwards across the top of the rifle and forms, with the end walls 19 and the short inward extensions 20 of the front wall 18, a discharge chute having a discharge outlet 13 at the opposite side of the rifle to the side at which the shells are ejected.

The lower portion of the front wall 18 is provided with two T-shaped cut-outs 21 which form part of a disengageable catch assembly for attaching the container 10 to the rifle and for this purpose, a co-operating mounting bracket 22 is adapted to be fixed to the side of the rifle beneath the breech 15. As shown, the mounting bracket 22 includes a base plate 23 which is apertured at opposite ends at 24 to enable it to be screwed to the stock of the gun supporting a pair of spaced apart square-capped connectors 25. These connectors 25 are adapted for passage through the respective enlarged square portions of the T-slots, whence the container may be made secure by forward movement to engage the respective stems 26 of the capped connectors within the corresponding narrow slots of the T-shaped cutouts 21.

The narrow portions of the T-slots 21 are tapered inwardly from their connection with the enlarged portion of the cutout and the capped connectors 25 are provided with inwardly tapering rear faces 27 to ensure that when the device is fully engaged it will be jammed firmly in a fixed position relative to the rifle.

As shown in FIG. 1, the container additionally includes in this embodiment a deflector plate assembly 28 having an arcuate mounting portion 29 adapted for screwed connection to the underside of the upper portion of the front face 18, and a flat deflector portion 30 which extends across above the action 15. Many rifles eject the spent shell from the one o'clock position so that in use, the shell is projected upwards to engage the deflector 30 and it is then deflected back through the inlet 9 in the front face 18 and into the lower containment portion 12. Of course, if the rifle 14 is fitted with telescopic sights as shown in dotted outline, the deflector plate assembly 28 is unscrewed to enable the telescopic sight to be operatively positioned on the rifle beneath the discharge chute and the telescopic sight performs the same deflection function as does the deflector plate 30. If the shell is ejected horizontally, the spent shell will pass straight into the container 10 after being deflected from the back wall 17.

In use, many spent shells may be collected in the lower containment means 12. These shells are recovered by the shooter by rotating the rifle about its longitudinal axis such that the container 10 is rolled with the rifle to a position therebetween so that the shells roll out along the arcuate discharge chute through to the discharge outlet 13 from which they may be collected in the palm of the hand of the shooter. Thus the shells can be retrieved simply by rotating the rifle and placing the hand at the outlet 13 to collect the shells. It is not necessary to remove the container 10 for emptying purposes.

Preferably, the container is made of a rigid plastic material able to withstand the temperature of the freshly ejected shells and the back wall 17 is perforated to enable the exhaust gases from the rifle to escape. The perforations are provided to enable not only the exhaust gases to escape but also to attenuate the noise created thereby.

In the preferred form of construction, the back wall 17 and the front wall 18 together with their respective side and bottom portions are moulded separately and connected together along the bead 31. As shown in FIG. 1, the junction zone of the two pieces along the bead 31 is of Z shape to ensure firm bonding between the parts.

As the container 10 shields the action 15 of the rifle 14, then in the case of an automatic rifle, the bolt handle 32 is also shielded. Accordingly, there is provided, according to the present invention, an extension handle for cocking the shielded bolt and comprising a flexible cord 33 having handle means 34 at one end and connector means 35 at the opposite end adapted to be fixed to the bolt handle 32. The flexible cord extension is chosen so that it will not interfere with the reciprocation of the bolt handle 32 of the automatic rifle 14. Preferably, the connection to the bolt handle is performed by means of a plastic sleeve 36 having a first hollow portion adapted to fit tightly about the bolt handle 32 and an outwardly projecting bead 37 about which the cord 33 may pass for securement thereto.

Preferably, the handle 34 is identical so that it may be used as a spare connection to the bolt handle 32. When the container 10 is connected to a manual bolt action rifle, the mounting bracket 22 is positioned so that the container 10 will be located operatively forwardly of the bolt in the cocked position.

Figure 5:
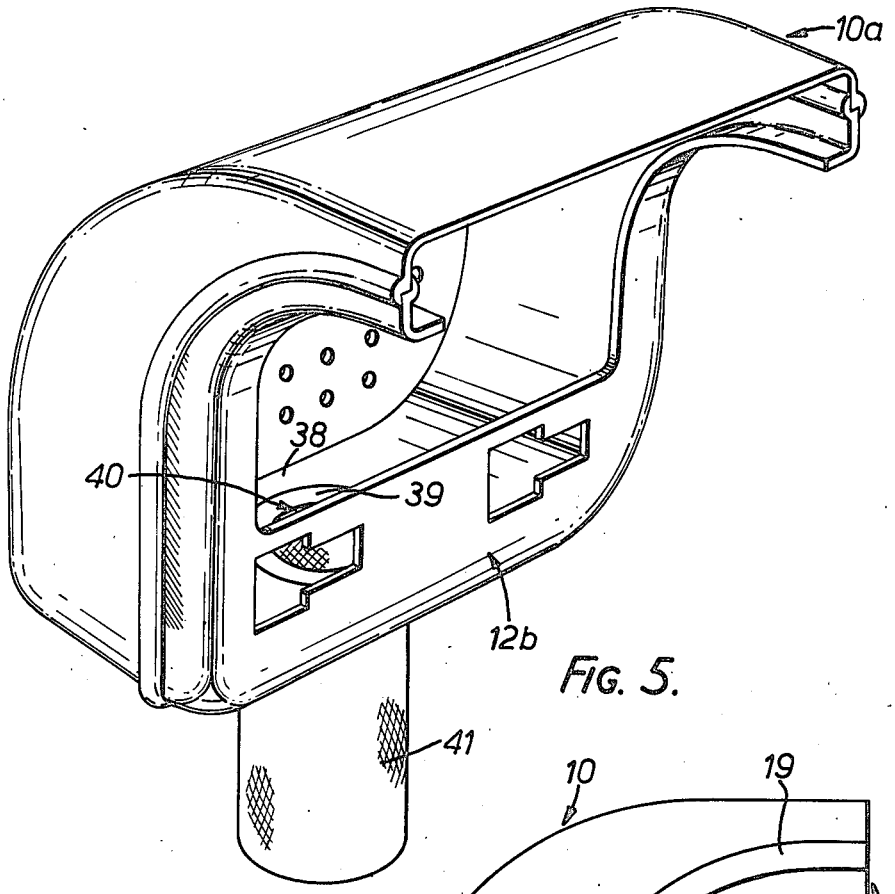
FIG. 5 is a perspective view of an alternate form of the container according to the present invention.
Figure 3:
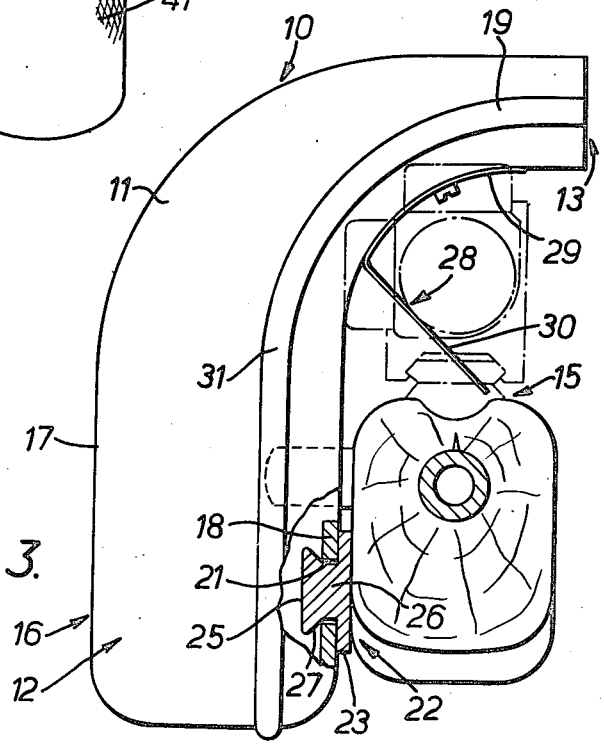
FIG. 3 is a front-end view showing the container disposed in operative relationship on a rifle.
Figure 4:
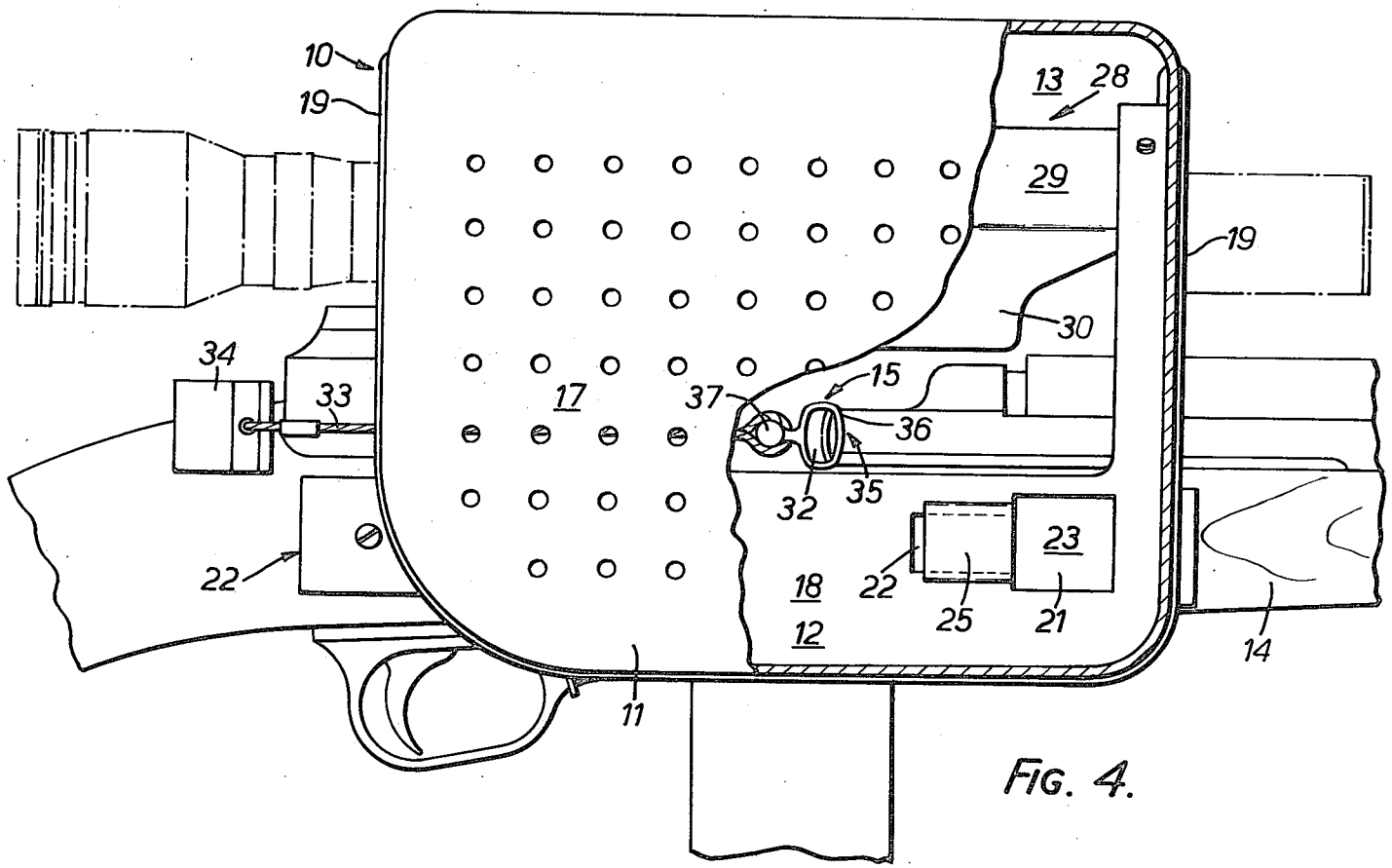
FIG. 4 is a side view corresponding to FIG. 3 and shown cut-away for clarity.

A further embodiment of the invention is shown in FIG. 5. This embodiment includes a modification in that the base 38 of the containment portion **12*b* is apertured and is provided with an outwardly extending annular flange lipped at its bottom edge to enable a fabric container 41 to be secured thereto. The base 38 is inclined towards the outlet opening 40 so that in use, as the spent shells are collected in the container 10*a*, they find their way through the outlet aperture 40 and into the fabric container 41. When this is full, it may be removed from the annular flange 39** with the spent shells contained therein and a fresh fabric container can be fitted for future use. The deflector means has been removed for use with a rifle fitted with telescopic sights.

Of course, the above has been given by way of illustrative example only, and it may be modified in many ways. For example, the embodiment shown in FIG. 5 may be formed without the discharge chute but with suitable deflector means which may be flexible and adapted to pass across the action of the rifle or the telescopic sights. Furthermore, the shells could be removed from the containment portion through, say, a trap door provided with manual release means. However, all such modifications and other variations as would be apparent to persons skilled in the art are deemed to fall within the broad scope and ambit of the invention as is defined in the appended claims.

I claim:

1. An assembly for gathering shells ejected from the action of a firearm comprising an open top container having at least front and rear walls for receiving said shells, and attachment means for removably securing said container to said firearm adjacent the action thereof, the rear wall of said container extending upwardly and across the action in spaced relation thereto for attachment of a telescopic sight to said firearm, said rear wall forming when inverted a discharge chute from said container for the shells collected therein, and deflection means secured to said container below said discharge chute to direct shells from said container, said deflection means and said discharge chute being so arranged that the assembly may be selectively used with said deflection means to collect shells from a firearm with an open sight and with or without said deflection means to collect shells from a firearm with a telescopic sight.

2. The assembly according to claim 1, wherein said container comprises a substantially rectangular housing and said rear wall extends arcuately upwardly past the opposite side of said firearm.

3. The assembly according to claim 1, wherein said attachment means comprises a disengageable catch assembly comprising a supporting part adapted to be fixed to said firearm and having connector means adapted to co-operate with engagement means on the front wall of said container, and the parts being so made and arranged that said container may be operatively supported on said firearm by engaging the co-operating parts of said catch assembly.

4. The assembly according to claim 3, wherein said connector means includes a pair of longitudinally spaced outwardly projecting headed lugs and said engagement means comprises a pair of spaced-apart T-shaped cutouts in the front wall of said container and each having an enlarged cutout portion continuous with a narrow elongate cutout portion, and said enlarged cutout portions being adapted to be simultaneously passed about a respective headed lug, whereafter said container may be moved along to engage said narrow portions behind said lug heads.

5. The assembly according to claim 2, wherein the walls of said container are perforated.

6. The assembly according to claim 4, wherein said supporting part is apertured for screwed connection to the stock of a firearm, and said container is moulded from a rigid plastic material.

* * * * *